US010011934B2

(12) United States Patent
Kim et al.

(10) Patent No.: US 10,011,934 B2
(45) **Date of Patent: *Jul. 3, 2018**

(54) WASHING MACHINE AND CONTROL METHOD THEREOF

(71) Applicant: SAMSUNG ELECTRONICS CO., LTD., Suwon-si, Gyeonggi-do (KR)

(72) Inventors: Hyun Sook Kim, Suwon-si (KR); Eun Suk Bang, Hwaseong-si (KR); Bo Ram Lee, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 272 days.

This patent is subject to a terminal disclaimer.

(21) Appl. No.: 14/918,139

(22) Filed: Oct. 20, 2015

(65) Prior Publication Data

US 2016/0040345 A1 Feb. 11, 2016

Related U.S. Application Data

(63) Continuation of application No. 12/385,586, filed on Apr. 13, 2009, now Pat. No. 9,194,074.

(30) Foreign Application Priority Data

Mar. 23, 2009 (KR) ..... 10-2009-0024460

(51) Int. Cl.
*D06F 33/02* (2006.01)
*D06F 35/00* (2006.01)
(Continued)

(52) U.S. Cl.
CPC ..... *D06F 33/02* (2013.01); *D06F 35/002* (2013.01); *D06F 39/003* (2013.01); *D06F 39/02* (2013.01);
(Continued)

(58) Field of Classification Search
CPC ..... D06F 33/02; D06F 39/083; D06F 39/088; D06F 35/002; D06F 2202/085;
(Continued)

(56) References Cited

U.S. PATENT DOCUMENTS

2003/0230122 A1 12/2003 Lee
2007/0289612 A1 12/2007 Minayoshi et al.
2008/0016626 A1 1/2008 Oak et al.

FOREIGN PATENT DOCUMENTS

CN 101092787 12/2007
CN 101285254 10/2008
(Continued)

OTHER PUBLICATIONS

Machine Translation of Takahashi et al., JP 2005102852 A, dated Apr. 2005.
(Continued)

*Primary Examiner* — David G Cormier
(74) *Attorney, Agent, or Firm* — Staas & Halsey LLP

(57) ABSTRACT

Disclosed herein are a washing machine and a control method thereof. The control method effectively transmits high-concentration wash liquid to laundry, while minimizing the amount of water used, through washing using bubbles, and maximizes the increase in volume of the wash liquid rubbed on the inner circumferential surface of the drum using the generation of bubbles and the rotation of the drum to raise the water level of the wash liquid without additional water.

17 Claims, 5 Drawing Sheets

(51) Int. Cl.

| | |
|---|---|
| ***D06F 39/02*** | (2006.01) |
| ***D06F 39/00*** | (2006.01) |
| ***D06F 39/08*** | (2006.01) |

(52) U.S. Cl.
CPC ..... *D06F 39/087* (2013.01); *D06F 39/088* (2013.01); *D06F 2202/085* (2013.01); *D06F 2202/10* (2013.01); *D06F 2204/06* (2013.01); *D06F 2204/086* (2013.01)

(58) Field of Classification Search
CPC ..... D06F 2204/06; D06F 2204/065; D06F 2204/082; D06F 2204/086
See application file for complete search history.

(56) References Cited

FOREIGN PATENT DOCUMENTS

| | | |
|---|---|---|
| EP | 1918441 | 5/2008 |
| JP | 2000-42283 | 2/2000 |
| JP | 2005102852 A | 4/2005 |
| KR | 10-2000-0045020 | 7/2000 |
| KR | 10-2004-0019849 | 3/2004 |
| KR | 10-2005-0097755 | 10/2005 |
| KR | 10-2007-0120409 | 12/2007 |
| KR | 10-2008-0039647 | 5/2008 |

OTHER PUBLICATIONS

Chinese Office Action dated Jul. 20, 2012, from Chinese Patent Application No. 201010123811.2.
European Search Report for corresponding European Patent Application No. 10152859.4 dated Sep. 1, 2010 (In English).
Restriction Requirement dated Nov. 3, 2011 from U.S. Appl. No. 12/385,586.
Office Action dated Feb. 8, 2012 from U.S. Appl. No. 12/385,586.
Office Action dated Jul. 6, 2012 from U.S. Appl. No. 12/385,586.
Office Action dated Dec. 10, 2014 from U.S. Appl. No. 12/385,586.
Notice of Allowance dated Jul. 23, 2015 from U.S. Appl. No. 12/385,586.
U.S. Appl. No. 12/385,586, filed Apr. 13, 2009, Hyun Sook Kim et al., Samsung Electronics Co., Ltd.
Korean Office Action dated Nov. 25, 2015 from Korean Patent Application No. 10-2009-0024460, 9 pages.
European Office Action dated Jun. 9, 2017 from European Patent Application No. 16179934., 27 pages.
European Decision on Grant dated May 9, 2016 from European Patent Application No. 10152859.4, 27 pages.
European Search Report dated Dec. 14, 2016 from European Patent Application No. 16179934.1, 7 pages.

WASHING MACHINE AND CONTROL METHOD THEREOF

CROSS-REFERENCE TO RELATED APPLICATIONS

This application is a continuation of U.S. patent application Ser. No. 12/385,586, filed on Apr. 13, 2009, which is currently pending, and claims the priority benefit of Korean Patent Application No. 10-2009-0024460, filed on Mar. 23, 2009 in the Korean Intellectual Property Office, the disclosures of each of which are incorporated herein by reference in their entirety.

BACKGROUND

1. Field

Embodiments of the present invention relate to a washing machine that improves washing efficiency using the generation of bubbles and the rotation of a drum and a control method thereof.

2. Description of the Related Art

Generally, a washing machine (i.e., a drum type washing machine) is an apparatus, including a water tub to store water (wash water or rinse water), and a cylindrical drum rotatably installed in the water tub to receive laundry. The washing machine also includes a motor to generate a drive force necessary to rotate the drum, to lift the laundry in the drum along the inner wall of the drum and drop the lifted laundry, during the rotation of the drum, thereby washing the laundry.

The washing machine performs washing through a series of operations, e.g., a washing operation to separate contaminants from laundry with water containing detergent (specifically, wash water), a rinsing operation to rinse out bubbles or residual detergent from the laundry with water containing no detergent (specifically, rinse water), and a spin-drying operation to spin-dry the laundry at high velocity. In the washing operation, when a user selects a washing course, the washing machine detects the weight (load amount) of the laundry to determine the amount of wash water, supplies water sufficient to wet the laundry and detergent into the water tub according to the determined amount of wash water, and performs a washing operation by a force to transmit wash liquid (water and detergent) to the laundry and drop the laundry through the rotation of the drum.

In a conventional washing machine, however, a space between the water tub and the drum is filed with water to perform the washing. As a result, water consumption is high, and a large amount of detergent is used. For washing with warm or hot water, a large amount of energy may be necessary to increase the temperature of supplied water.

Also, it may be necessary to effectively transmit the water liquid to the laundry placed in the washing machine at the center of the washing machine so as to improve washing efficiency. However, it may be difficult to raise the level of the water without additional water due to the structural characteristics of the washing machine. Furthermore, the detergent supplied with the wash water may not be efficiently transmitted into the washing machine. As a result, the concentration of the water liquid may drop, and therefore, high-concentration washing may not be achieved.

SUMMARY

Therefore, it is an aspect of the exemplary embodiment to provide a washing machine that effectively transmits high-concentration wash liquid to laundry, while minimizing the amount of water used, thereby improving washing efficiency, and a control method thereof.

It is another aspect of the present exemplary embodiment to provide a washing machine that maximizes the increase in volume of wash liquid using the generation of bubbles and the rotation of a drum to raise the water level of the wash liquid without additional water and thus effectively rapidly transmit the wash liquid to laundry, and a control method thereof.

Additional aspects and/or advantages will be set forth in part in the description which follows and, in part, will be apparent from the description, or may be learned by practice of the invention.

The foregoing and/or other aspects are achieved by providing a control method of a washing machine including supplying water and detergent into a water tub to form wash liquid, forcibly generating bubbles using the wash liquid, and transmitting the wash liquid bubbles to laundry.

The level of the wash liquid supplied into the water tub may be lower than the bottom of a drum.

The control method may further include circulating the wash liquid to raise the level of the wash liquid by the generation of the bubbles such that the level of the wash liquid is higher than the bottom of the drum.

The control method may further include rotating the drum installed in the water tub to increase a volume of the wash liquid.

The control method includes increasing an operation time to generate the bubbles, and decreasing or omitting a drum rotating time to increase the volume of the wash liquid when the laundry requires a delicate washing.

The generating the bubbles may include circulating the wash liquid to raise a level of the wash liquid such that the level of the wash liquid is higher than an initial level of the wash liquid supplied into the water tub.

The generating the bubbles may further include circulating the wash liquid for a first predetermined time to raise the level of the wash liquid.

The generating the bubbles may further include circulating the wash liquid to raise the level of the wash liquid until the level of the wash liquid reaches a first predetermined water level.

The generation of the bubbles may be stopped during the rotation of the drum.

The generation of the bubbles may continue during the rotation of the drum.

The rotating the drum may include rotating the drum in one direction to raise the level of the wash liquid to a center of the drum.

The control method may further include rotating the drum in alternating directions for a second predetermined time to increase a volume of the wash liquid, and rotating the drum at a higher velocity than the rotating in alternating directions.

The control method may further include rotating the drum in alternating directions until the level of the wash liquid reaches a second predetermined water level, to increase a volume of the wash liquid. The rotating the drum in one direction is at a higher velocity than the rotating in alternating directions.

The control method may further include detecting an amount of load based on a weight of the laundry and setting a number of times a soaping operation is performed and an operation time based on the amount of load.

The control method may further include directly supplying water to the laundry to wet the laundry.

The foregoing and/or other aspects are also achieved by providing a control method of a washing machine including supplying water and detergent to a water tub, generating bubbles using wash liquid obtained by mixing the water and the detergent, and performing a soaping operation to transmit the wash liquid to laundry, including using the bubbles and rotating of the drum, and washing the laundry with the bubbles.

The control method may further include driving a bubble generating device to generate the bubbles, and circulating the wash liquid in the water tub with the bubble generating device to generate the bubbles.

The soaping operation may include generating the bubbles to raise the level of the wash liquid to be higher than the bottom of the drum and rotating the drum to increase a volume of the raised wash liquid.

The foregoing and/or other aspects are also achieved by providing a washing machine including a water tub, a water supply unit to supply water into the water tub, a circulation unit to circulate the water supplied into the water tub, a drum installed in the water tub to receive laundry, and a controller to control the water supply unit to supply the water and detergent into the water tub, to control the circulation unit to generate bubbles in wash liquid obtained by mixing the water and the detergent, to control the drum to be rotated to increase a volume of the wash liquid. A level of the wash liquid being raised by the generation of the bubbles, and to control the wash liquid having the increased volume to be transmitted to the laundry.

The controller may control the water supply unit to be stopped when the level of the wash liquid reaches a bubble generation water level, and may control the circulation unit to be driven until the level of the wash liquid reaches a first water level higher than a bottom of the drum.

The controller may control the drum to be rotated until the level of the wash liquid reaches a second water level higher than the first water level after the level of the wash liquid reaches the first water level.

The controller may detect an amount of load based on a weight of the laundry, and may set a number of times the bubbles are generated and the drum is rotated and an operation time based on the detected load.

The controller may increase a bubble generation time, and may decrease or stop the rotation of the drum, when the detected load is relatively small.

The circulation unit may include an air introduction device to introduce air into the wash liquid.

BRIEF DESCRIPTION OF THE DRAWINGS

These and/or other aspects of the exemplary embodiment will become apparent and more readily appreciated from the following description, taken in conjunction with the accompanying drawings of which.

DETAILED DESCRIPTION OF EMBODIMENT

Figure 1:
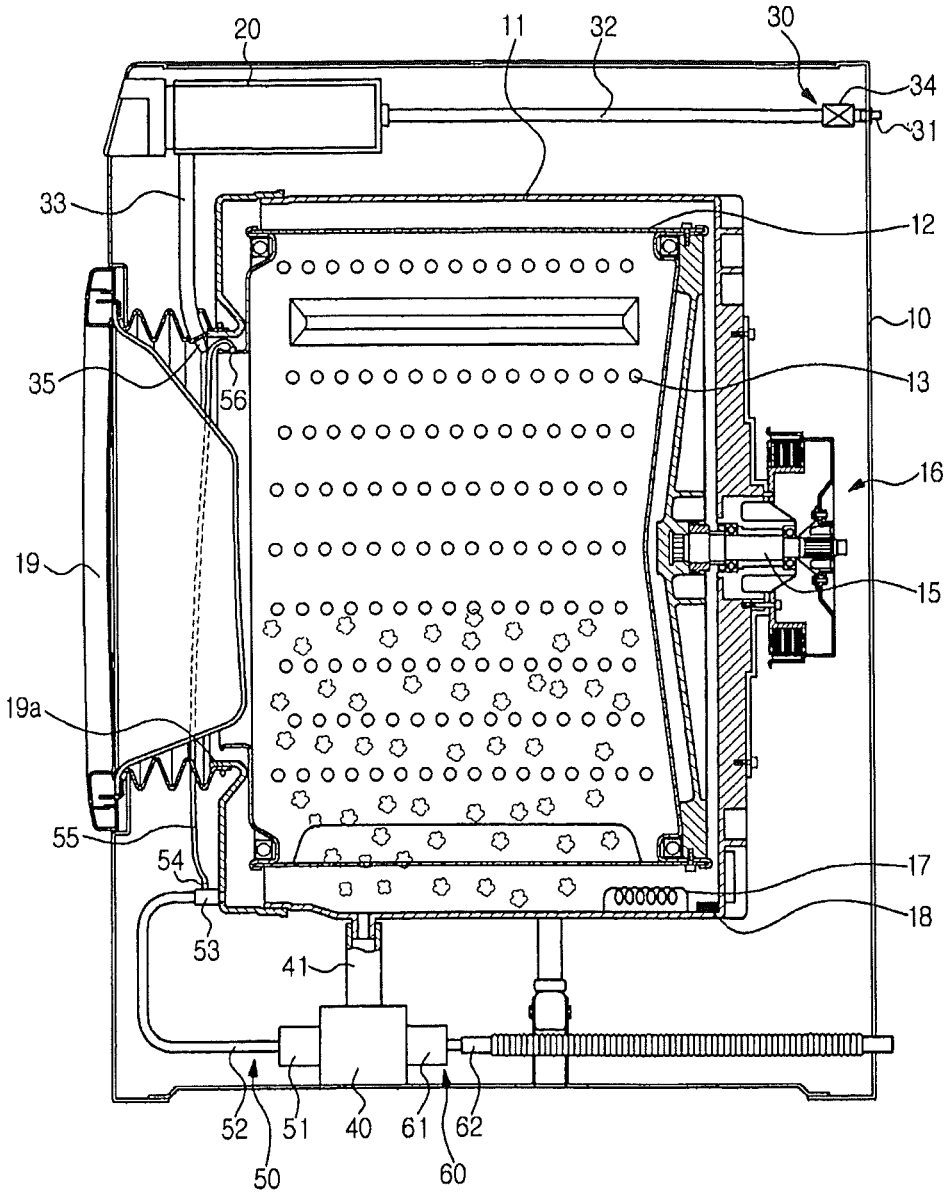
FIG. 1 is a sectional view illustrating the structure of a washing machine according to an exemplary embodiment.

Reference will now be made in detail to the exemplary embodiment, an example of which is illustrated in the accompanying drawings, wherein like reference numerals refer to the like elements throughout. The embodiment is described below to explain the present invention by referring to the figures.

FIG. 1 is a sectional view illustrating the structure of a washing machine according to an exemplary embodiment.

In FIG. 1, the washing machine includes a drum-type water tub 11 mounted in a machine body 10 to receive water (wash water or rinse water) and a cylindrical drum 12 rotatably mounted in the water tub 11. The cylindrical drum 12 has a plurality of holes 13.

Outside the rear of the water tub 11 is mounted a drive unit, such as a motor 16, to rotate a rotary shaft 15 connected to the drum 12 such that washing, rinsing, and spin-drying operations are performed. At the inside bottom of the water tub 11 are mounted a washing heater 17 to heat water (specifically, wash liquid) present in the water tub 11 and a water level sensor 18 to sense frequency variation depending upon the water level and thus the amount of water (the water level).

The water level sensor 18 controls a wash water level at which the wash liquid is not introduced into the drum 12 having the laundry placed therein such that bubbles are generated to wash the laundry (an optimum water level necessary to generate bubbles, which is the level of the wash liquid lower than the bottom of the drum; hereinafter, referred to as a bubble generation water level). When wash liquid supplied during bubble washing reaches the bubble generation water level, the supply of water (wash water) is stopped such that the wash liquid is not introduced into the drum 12.

At the front of the machine body 10 is mounted a door 19 having an inlet 19*a* through which laundry is put into or removed from the drum 12. Above the water tub 11 are mounted a detergent supply unit 20 to supply detergent and a water supply unit 30 to supply water (wash water or rinse water).

The detergent supply unit 20 has a plurality of partitioned spaces. The detergent supply unit 20 is mounted at the front side of the machine body 10 such that a user easily puts detergent and rinse in the respective partitioned spaces.

The water supply unit 30 includes a first water supply pipe 32 connected between an external water supply pipe 31, through which water (wash water or rinse water) is supplied into the water tub 11, and the detergent supply unit 20, a second water supply pipe 33 connected between the detergent supply unit 20 and the water tub 11, a water supply valve 34 mounted on the first water supply pipe 32 to control the supply of water, and a water supply nozzle 35 mounted at the outlet of the second water supply pipe 33. In this structure, water is supplied into the water tub 11 via the detergent supply unit 20 such that detergent is supplied into the water tub 11 together with the water.

Also, a circulation unit 50 to circulate the water in the water tub 11 and a drainage unit 60 to drain the water in the water tub 11 are mounted at a pump case 40 below the water tub 11 in a symmetrical fashion. Between the water tub 11 and the pump case 40 is connected a connection hose 41 to guide the water in the water tub 11 to the pump case 40.

The circulation unit 50 includes a circulation pump 51 to supply the water guided to the pump case 40 into the water tub 11, a circulation pipe 52 mounted at the outlet of the circulation pump 51 to circulate the water, a circulation nozzle 53 mounted at the outlet of the circulation pipe 52 to supply the water into the lower part of the water tub 11, an air introduction hole 54 formed at the circulation nozzle 53 to introduce air necessary to generate bubbles from the water (specifically, wash liquid) to be supplied into the lower part of the water tub 11, and an air guide pipe 55 to guide air in the drum 12 to the air introduction hole 54 through an air suction hole 56.

One side of the circulation pipe 52 is connected to the circulation pump 51, and the other side of the circulation pipe 52 is connected to the water tub 11. Upon driving the circulation pump 51, the water in the water tub is guided to the pump case 40 through the connection hose 41. The water guided to the pump case 40 is resupplied into the water tub 11 through the circulation pipe 52. In this way, water circulation is achieved. The circulation pipe 52 connected to the water tub is mounted at the lowest possible position such that the circulated water is smoothly supplied to the lower part of the water tub 11.

The circulation nozzle 53 is formed of a venturi that lowers the pressure of the circulated water. Air introduced through the air suction hole 56 is naturally introduced into the circulation nozzle 53 through the air introduction hole 54 via the air guide pipe 55 such that the detergent in the wash liquid is formed into an aggregate to generate bubbles without an additional power unit to supply air.

In this embodiment, the circulation unit 50 generates bubbles such that the laundry placed in the drum 12 is washed by the bubbles. A principle of bubble generation is as follows.

As water (wash liquid) discharged from the circulation pump 51 passes through the circulation nozzle 53 via the circulation pipe 52, the pressure of the water suddenly drops, with the result that air in the drum 12 is introduced into the circulation nozzle 53 through the air introduction hole 54. Consequently, air bubbles are generated in the water (wash liquid) to be supplied to the lower part of the water tub 11. The air bubbles are combined with the detergent in the wash liquid. Consequently, the volume of the wash liquid increases, and the laundry placed in the drum 12 is washed by the bubbles.

The drainage unit 60 includes a drainage pump 61 to drain water guided to the pump case 40 outside and a drainage pipe 62 mounted at the outlet of the drainage pump 61 to drain the water.

In this embodiment, the washing machine performs a soaping operation including a first bubble generation process to generate bubbles to raise the level of the wash liquid such that the level of the wash liquid is higher than the bottom of the drum 12, thereby improving wash liquid transmission efficiency through the raising of the level of the wash liquid and a second drum control process to rotate the drum 12 in one direction to further raise the level of the wash liquid, thereby further improving the wash liquid transmission efficiency through the increase in volume of the wash liquid by the rotation of the drum 12 and the friction between the drum 12 and the wash liquid.

The soaping operation is performed to obtain an effect similar to rubbing the laundry with soap before a main washing operation is performed. The soap operation effectively transmits high-concentration wash liquid to the laundry, while minimizing the amount of water use, using the generation of bubbles and the rotation of the drum 12.

In the first bubble generation process of the soaping operation, the circulation pump 51 is driven for a predetermined time (a bubble generation time necessary to raise the level of the wash liquid such that the level of the wash liquid is higher than the bottom of the drum; hereinafter, referred to as a first time) or until the wash water reaches a predetermined water level (a water level at which the level of the wash liquid is higher than the bottom of the drum; hereinafter, referred to as a first water level) to generate bubbles in the wash liquid, thereby improving the wash liquid transmission efficiency in which the wash liquid is transmitted to the laundry placed in the drum 12 through the raising of the water level of the wash liquid.

In the second drum control process of the soaping operation, the velocity of the drum 12 is rotated in one direction at a higher velocity (about 100 to about 200 RPM) than an alternating rotation velocity (about 45 to about 50 RPM) for washing for a predetermined time (a bubble generation time necessary to rapidly transmit the wash liquid to the laundry placed in the drum at the center of the drum through the increase in volume of the wash liquid; hereinafter, referred to as a second time). Alternatively, the higher velocity rotation may occur until the wash water reaches a predetermined water level (a water level at which the wash liquid is rapidly transmitted to the laundry placed in the drum at the center of the drum; hereinafter, referred to as a second water level) to maximize the increase in volume of the wash liquid and thus to raise the level of the wash liquid without additional water, after the first bubble generation process. Thus, the wash liquid transmission efficiency in which the wash liquid is transmitted to the laundry placed in the drum 12 at the center of the drum is further improved.

Figure 2:
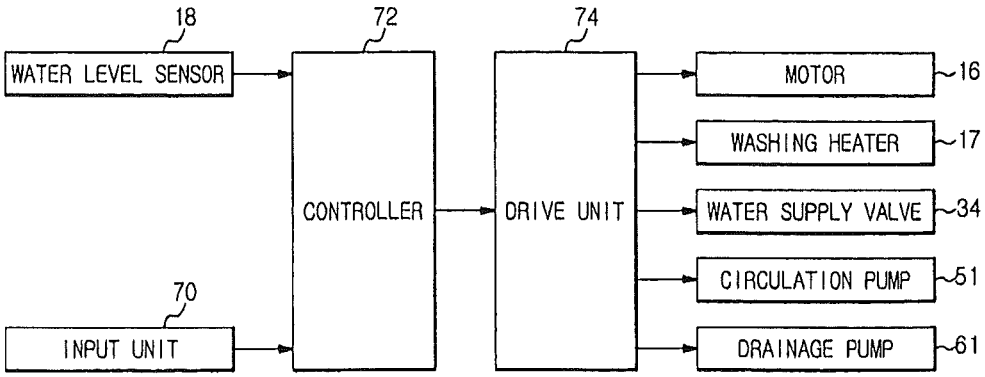
FIG. 2 is a control block diagram of the washing machine according to the exemplary embodiment.

FIG. 2 is a control block diagram of the washing machine according to the embodiment of the present invention. The washing machine further includes an input unit 70, a controller 72, and a drive unit 74.

The input unit 70 inputs operation information, such as a washing course (for example, normal washing or bubble washing), spin-drying RPM, and the addition of rinsing, which are selected by a user, to the controller.

The controller 72 is a microcomputer to control the overall operations of the washing machine, such as washing, rinsing, and spin-drying, based on the operation information input from the input unit 70. The controller 72 stores motor RPM, bubble generation operation rate (air pump on-off time), and washing time set according to the amount of load (the weight of laundry) in the selected washing course.

For bubble washing, therefore, the controller 72 controls the motor RPM and the bubble generation operation rate based on the amount of load such that the motor 16 and the circulation pump 51 are driven to effectively perform the washing operation.

Also, the controller 72 controls the driving of the motor 16 and the circulation pump 51 to increase the number of times the first bubble generation process and the second drum control process are repeated and the operation time when the amount of load is large during the soaping operation and to increase the operation time for the first bubble generation process and reduce or even omit the rotation of the drum 12 for laundry requiring delicate washing, such as wool or silk, which is likely to be damaged by a mechanical action and having a small amount of load, thereby achieving the optimum washing efficiency while reducing the damage to the laundry.

The drive unit 74 drives the motor 16, the washing heater 17, the water supply valve 34, the circulation pump 51, and the drainage pump 61 according to a drive control signal of the controller 72.

Hereinafter, a control method of the washing machine with the above-stated construction will be described.

Figure 3:
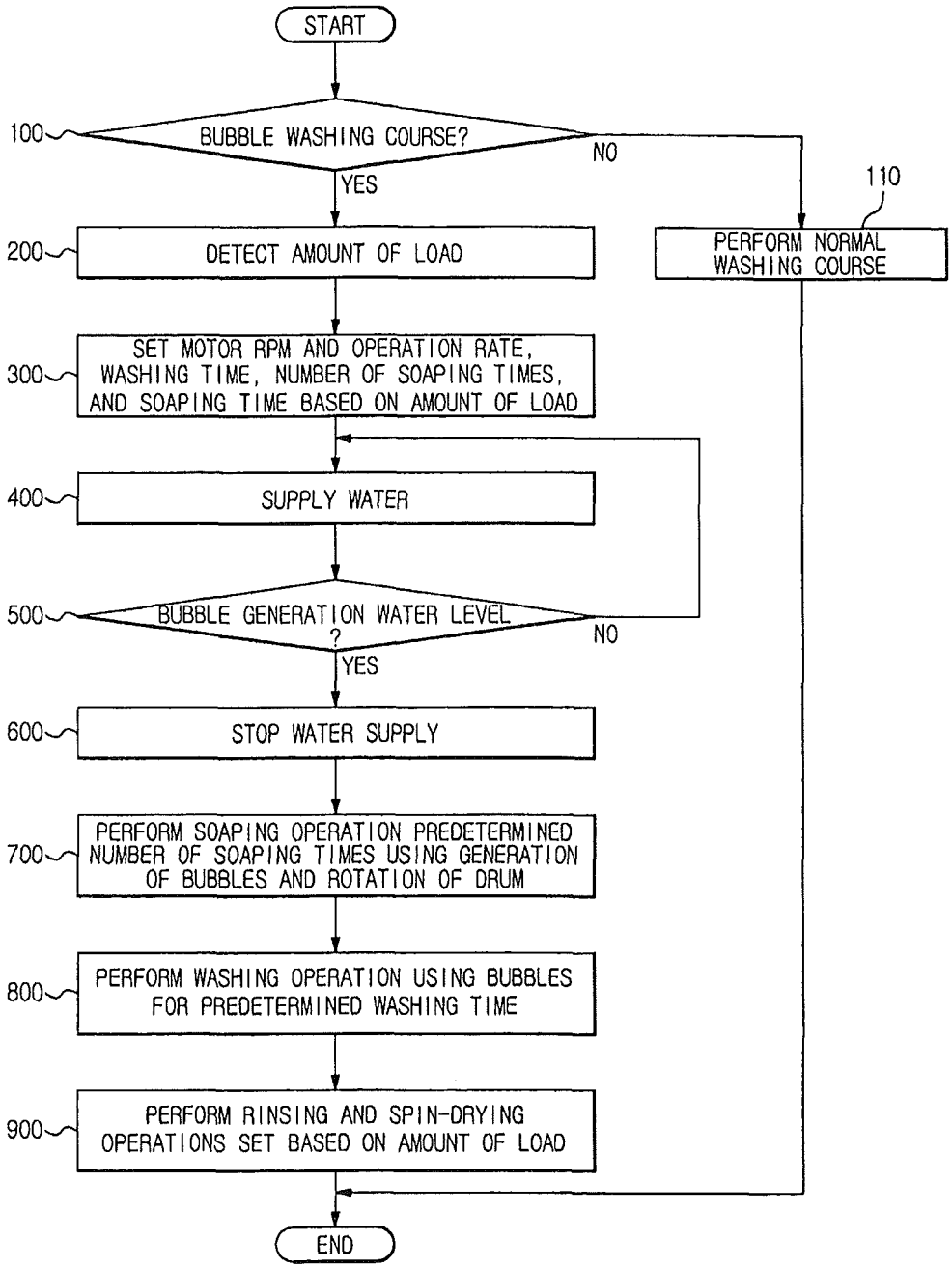
FIG. 3 is a flow chart illustrating an overall operation control process of the washing machine according to the exemplary embodiment.

FIG. 3 is a flow chart illustrating an overall operation control process of the washing machine according to the embodiment of the present invention, which is an algorithm to effectively transmit wash liquid to laundry placed in the drum 12 while minimizing the amount of water used through washing using bubbles.

When a user puts laundry into the drum 12 and selects operation information, such as a bubble washing course, spin-drying RPM, and the addition of rinsing, the operation information selected by the user is input to the controller 72 through the signal input unit 70.

The controller 72 determines whether the washing course selected by the user is a bubble washing course based on the operation information input from the input unit 70 (100). When the washing course selected by the user is not the bubble washing course, a normal washing course is performed in the same manner as a conventional washing course (110).

When the washing course selected by the user is the bubble washing course, the controller 72 detects the amount of load (the weight of the laundry) placed in the drum 12 (200), and sets motor RPM and operation rate, washing time, the number of soaping times, and soaping time based on the detected amount of load (300).

Subsequently, the controller 72 controls the water supply valve 34 to supply high-concentration wash liquid necessary to generate bubbles such that water (specifically, wash water) is supplied into the water tub 11 through the detergent supply unit 20 via the first water supply pipe 32. At this time, detergent in the detergent supply unit 20 is dissolved in the supplied water (wash water), and is supplied into the water tub 11 through the water supply nozzle 35 via the second water supply pipe 33 together with the water (wash water). As a result, the wash liquid (water and detergent) is supplied into the lower part of the water tub 11 (specifically, between the water tub and the drum) (400).

At this time, the water level of the supplied wash liquid is sensed by the water level sensor 18 to determine whether the water level is a predetermined bubble generation water level (about ¼ of a normal wash water level) (500). When the water level is not the bubble generation water level, wash liquid is continuously supplied until the water level reaches the bubble generation water level. When the water level is the bubble generation water level, the controller 72 controls the water supply valve 34 to be turned off such that the supply of water is stopped (600).

When the supply of the wash liquid to the bubble generation water level is completed, the controller 72 performs a soaping operation to increase the volume of the wash liquid using the generation of bubbles and the rotation of the drum 12, such that the water level of the wash liquid is increased a predetermined number of times and for a soaping time to obtain an effect similar to rubbing the laundry placed in the drum 12 with soap before a main washing operation using bubbles is performed (700).

In this embodiment, the soaping operation is performed immediately after the supply of water, to which, however, the exemplary embodiment of the present invention is not limited. For example, a soaking operation to supply a small amount of water and soak the laundry may be performed before the soaping operation such that the volume of the laundry is reduced, and therefore, the wash liquid is effectively transmitted to the laundry. The execution of the soaking operation may be controlled based on the amount of load. For small-load washing, such as a delicate course or a wool course, for example, the soaking operation may be omitted because the volume of laundry is small although the laundry is not wetted.

When the soaping operation to transmit the wash liquid to the laundry placed in the drum 12 at the center of the drum through the raising of the water level of the wash liquid is completed, the controller 72 rotates the drum 12 in alternating directions at the predetermined motor RPM and operation rate to perform a washing operation using bubbles for a predetermined washing time (800).

When the washing operation using the bubbles is completed, the controller 72 performs rinsing and spin-drying operations set based on the amount of load to end the washing (900).

Hereinafter, the soaping operation using the generation of bubbles and the rotation of the drum 12 will be described.

Figure 4:
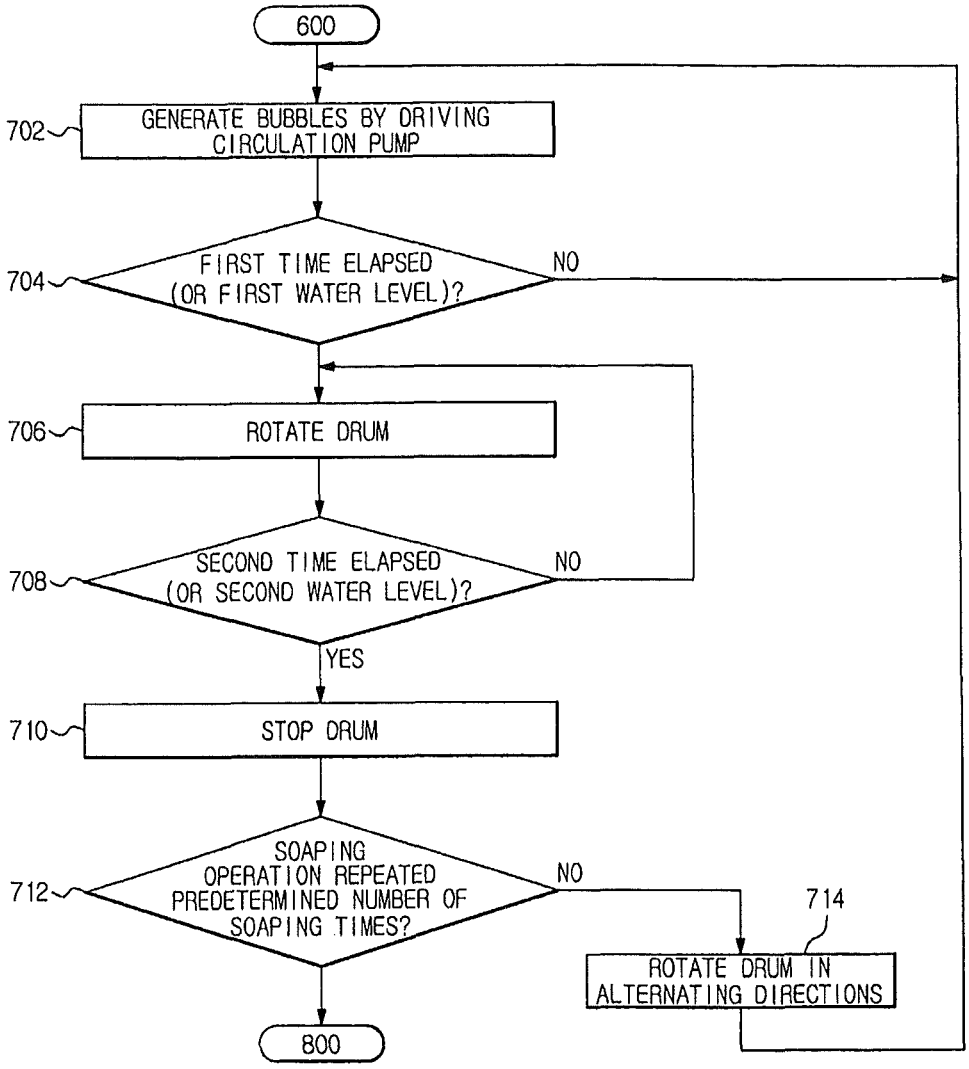
FIG. 4 is a flow chart illustrating a control process of a soaping operation using the generation of bubbles and the rotation of a drum in the washing machine according to the exemplary embodiment.

FIG. 4 is a flow chart illustrating a control process of the soaping operation using the generation of bubbles and the rotation of the drum in the washing machine according to the embodiment of the present invention.

In FIG. 4, when the supply of the wash liquid to the bubble generation water level is completed (Operation 600 of FIG. 3), the controller 72 controls the circulation pump 51 to generate bubbles in the wash liquid supplied to the lower part of the water tub 11 (702). A principle of generating bubbles by the circulation pump 51 is as follows.

When the circulation pump 51 is driven, water in the water tub 11 is guided to the pump case 40 through the connection hose 41. The water guided to the pump case 40 is resupplied to the lower part of the water tub 11 through the circulation pipe 52. In this way, water circulation is achieved. When the water passes through the circulation nozzle 53 via the circulation pipe 52, the water pressure is suddenly lowered. As a result, air is naturally introduced into the circulation nozzle 53 through the air introduction hole 54 and generates bubbles in the water (wash liquid) supplied to the lower part of the water tub 11.

The bubbles generated by the driving of the circulation pump 51 are introduced into the drum 12 through the holes or the front of the drum 12 and effectively transmits the wash liquid to the laundry placed in the drum 12.

The controller 72 determines whether a first predetermined time has elapsed (or the water level of the wash liquid sensed by the water level sensor is a first water level) (704). When the first predetermined time has not elapsed (or the water level is not the first water level), the controller 72 controls the circulation pump 51 to be driven, until the first predetermined time elapses (or the water level reaches the first water level), to perform a first bubble generation process to raise the water level of the wash liquid such that the level of the wash liquid is higher than the bottom of the drum 12.

When it is determined at operation 704 that the first predetermined time has elapsed (or the water level is the first water level), the controller 72 controls the drum 12 to be rotated in one direction at a higher velocity (about 100 to about 200 RPM) than an alternating rotation velocity (about 45 to about 50 RPM) for washing (706). At this time, the circulation pump 51 may be continuously driven or stopped. This is because, when the drum 12 is rotated in one direction at a higher velocity than the alternating rotation velocity for washing, the volume of the wash liquid is increased by the rotation of the drum 12 and the friction between the drum 12 and the wash liquid, with the result that the generation of bubbles is accelerated, and therefore the water level of the wash liquid is further raised. Consequently, the wash liquid is rapidly transmitted to the laundry located in the drum 12 at the center of the drum, and therefore, the generation of bubbles by the driving of the circulation pump 51 may be omitted.

Subsequently, the controller 72 determines whether a second predetermined time has elapsed (or the water level of the wash liquid sensed by the water level sensor is a second water level) (708). When the second predetermined time has not elapsed (or the water level is not the second water level), the controller 72 controls the drum 12 to be rotated, until the second predetermined time elapses (or the water level reaches the second water level), to perform a second drum control process to raise the water level of the wash liquid to the center of the drum 12 without additional water.

When it is determined at Operation 708 that the second predetermined time has elapsed (or the water level is the second water level), the controller 72 controls the drum 12 to be stopped (710), and determines whether a soaping operation including the first bubble generation process and the second drum control process has been repeated a predetermined number of soaping times (or for a soaping time) (712).

When it is determined at operation 712 that the soaping operation has been repeated the predetermined number of soaping times (or for the soaping time), a washing operation using bubbles is performed (800). When the soaping operation has not been repeated the predetermined number of soaping times (or for the soaping time), the drum 12 is rotated in alternating directions for a predetermined time (about 10 seconds) (714) to stir the laundry, and the procedure returns to operation 702 where the soaping operation including the first bubble generation process and the second drum control process is repeated.

The predetermined soaping times (or the soaping time) may be changed based on load or a course. For small-load washing, such as a delicate course or a wool course, the first bubble generation process may be performed for an increased time, and the second drum control process may be performed for a decreased time or even omitted.

Hereinafter, the washing operation using bubbles will be described with reference to FIG. 5.

Figure 5:
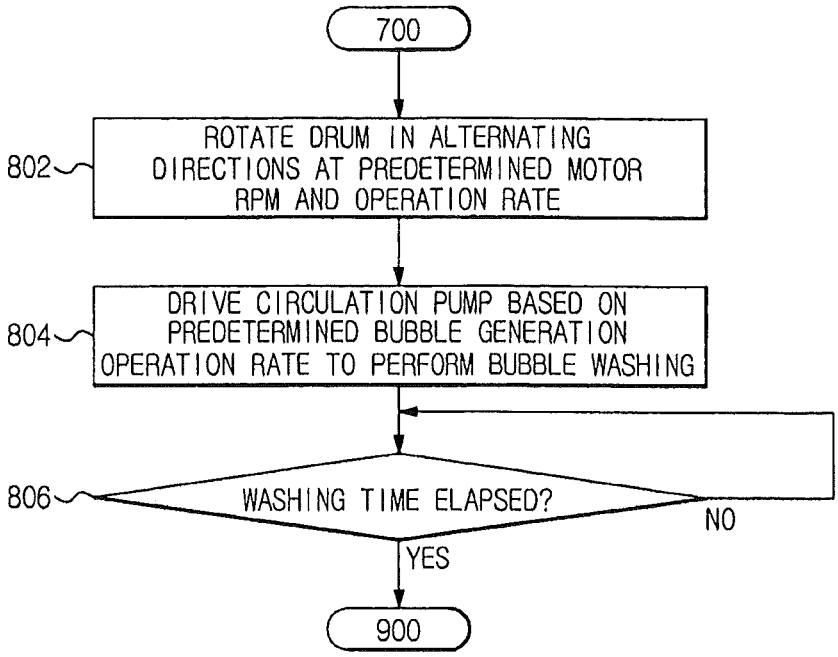
FIG. 5 is a flow chart illustrating a control process of a washing operation using bubbles in the washing machine according to the exemplary embodiment.

FIG. 5 is a flow chart illustrating a control process of the washing operation using bubbles in the washing machine according to the embodiment of the present invention.

In FIG. 5, when the soaping operation is completed (operation 700 of FIG. 3), the controller 72 controls the drum 12 to be rotated in alternating directions at predetermined motor RPM and operation rate (802), and controls the circulation pump 51 to be driven according to a predetermined bubble generation operation rate, such that the washing operation using bubbles is performed for a predetermined washing time (806).

Contaminants are effectively removed from the laundry by high wash liquid concentration of bubbles dispersed widely in the drum 12 through the alternating rotation of the drum 12 after the generation of the bubbles. When friction occurs between the wash liquid falling by the rotation of the drum 12 and the laundry, the bubbles act as cushions to prevent the laundry from being damaged due to the friction.

In this embodiment, the circulation pump 51 and drainage pump 61 are mounted at the pump case 40 in a symmetrical fashion, to which, however, the exemplary embodiment are not limited thereto. For example, the circulation pump 51 and drainage pump 61 may be mounted side by side at the lower front of the machine body 10. Also, the circulation pump 51 and drainage pump 61 may be applied to any structures to circulate and drain water.

In this embodiment, the water tub 11 is installed parallel to an installation plane of the washing machine, to which, however, the exemplary embodiments of the present invention are not limited thereto. For example, the water tub 11 may be installed at a predetermined angle to the installation plane of the washing machine.

As is apparent from the above description, an exemplary embodiment has the effect of effectively transmitting high-concentration wash liquid to laundry, while minimizing the amount of water used, through washing using bubbles, and maximizing the increase in volume of the wash liquid rubbed on the inner circumferential surface of the drum using the generation of bubbles and the rotation of the drum to raise the water level of the wash liquid without additional water. Thus, the wash liquid is effectively and quickly transmitted to the laundry, thereby reducing water and energy consumption and improving washing efficiency.

Although an exemplary embodiment has been shown and described, it would be appreciated by those skilled in the art that changes may be made in this embodiment without departing from the principles and spirit of the invention, the scope of which is defined in the claims and their equivalents.

What is claimed is:

1. A control method comprising:

supplying water and detergent into a water tub of a washing machine to form wash liquid, wherein a drum is installed in the water tub to receive laundry;

generating bubbles to raise a level of the wash liquid by circulating the wash liquid with a circulating unit; and accelerating the generation of the bubbles to further raise the level of the wash liquid by rotating the drum at a higher drum speed than a drum speed of a washing operation of the washing machine.

2. The control method according to claim 1, further comprising changing an operation time for the generating the bubbles, and changing an operation time of the rotating the drum based on a washing cycle of the washing machine.

3. The control method according to claim 1, wherein the generating the bubbles further comprises circulating the wash liquid for a first predetermined time to raise the level of the wash liquid.

4. The control method according to claim 1, wherein the generating the bubbles further comprises circulating the wash liquid to raise the level of the wash liquid until the level of the wash liquid reaches a first predetermined water level.

5. The control method according to claim 1, further comprising stopping the generation of the bubbles once a predetermined time has passed since the rotating the drum at the higher drum speed has begun.

6. The control method according to claim 1, wherein the rotating the drum comprises rotating the drum in one direction to raise the level of the wash liquid to a center of the drum.

7. The control method according to claim 6, further comprising rotating the drum in alternating directions for a predetermined time to increase a volume of the wash liquid, and the rotating the drum in one direction comprises rotating the drum at a higher velocity than the rotating in alternating directions.

8. The control method according to claim 6, further comprising rotating the drum in alternating directions until the level of the wash liquid reaches a predetermined water level, to increase a volume of the wash liquid, wherein the rotating the drum in one direction comprises rotating the drum at a higher velocity than the rotating in the alternating directions.

9. The control method according to claim 1, wherein an initial level of the wash liquid supplied into the water tub is lower than a bottom of the drum, and the control method further comprises circulating the wash liquid to raise the level of the wash liquid by the generation of the bubbles such that the level of the wash liquid is higher than the bottom of the drum.

10. The control method according to claim 1, wherein the drum is rotated at the higher drum speed in one direction at about 100 to about 200 RPM to increase a volume of the wash liquid.

11. The control method according to claim 1, wherein the washing operation is carried out by a rotation of the drum at an alternating rotation velocity of about 45 to about 50 RPM.

12. A washing machine comprising:

a water tub;

a water supply unit to supply water into the water tub;

a circulation unit to circulate the water supplied into the water tub;

a drum installed in the water tub to receive laundry; and a controller configured:

to control the water supply unit to supply the water and detergent into the water tub to form wash liquid, to control the circulation unit to generate bubbles to raise a level of the wash liquid by circulating the wash liquid, and to accelerate the generation of the bubbles to further raise the level of the wash liquid by controlling the drum to be rotated at a higher drum speed than a drum speed of a washing operation of the washing machine.

13. The washing machine according to claim 12, wherein the controller controls the water supply unit to be stopped when the level of the wash liquid reaches a bubble generation water level, and controls the circulation unit to be driven until the level of the wash liquid reaches a first water level higher than a bottom of the drum.

14. The washing machine according to claim 13, wherein the controller controls the drum to be rotated until the level of the wash liquid reaches a second water level which is higher than the first water level, after the level of the wash liquid reaches the first water level.

15. The washing machine according to claim 12, wherein the controller detects an amount of load based on a weight of the laundry, and sets a number of times the bubbles are generated and the drum is rotated and an operation time based on the detected load.

16. The washing machine according to claim 15, wherein the controller changes a bubble generation time, and changes the operation time of the rotation of the drum, based on a washing cycle of the washing machine.

17. The washing machine according to claim 12, wherein the circulation unit comprises an air introduction device to introduce air into the wash liquid.

* * * * *